US011271349B2

(12) United States Patent
Zhou et al.

(10) Patent No.: US 11,271,349 B2
(45) Date of Patent: Mar. 8, 2022

(54) ELECTRICAL CONNECTOR WITH STOP POSITIONED ON METALLIC SHELL

(71) Applicants: FOXCONN (KUNSHAN) COMPUTER CONNECTOR CO., LTD., Kunshan (CN); FOXCONN INTERCONNECT TECHNOLOGY LIMITED, Grand Cayman (KY)

(72) Inventors: Shao-Cong Zhou, Huaian (CN); Jun Zhao, Huaian (CN)

(73) Assignees: FOXCONN (KUNSHAN) COMPUTER CONNECTOR CO., LTD., Kunshan (CN); FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 16/987,354

(22) Filed: Aug. 6, 2020

(65) Prior Publication Data

US 2021/0044061 A1 Feb. 11, 2021

(30) Foreign Application Priority Data

Aug. 6, 2019 (CN) ..... 201921260057.X

(51) Int. Cl.

| | |
|---|---|
| ***H01R 13/6594*** | (2011.01) |
| ***H01R 12/71*** | (2011.01) |
| ***H01R 24/60*** | (2011.01) |
| ***H01R 13/6581*** | (2011.01) |

(52) U.S. Cl.

CPC ..... *H01R 13/6594* (2013.01); *H01R 12/716* (2013.01); *H01R 13/6581* (2013.01); *H01R 24/60* (2013.01)

(58) Field of Classification Search

CPC .. H01R 13/6594; H01R 12/716; H01R 24/60; H01R 13/6581

USPC ..... 439/660, 676, 607.01, 607.13, 607.27, 439/607.35, 607.4, 607.55

See application file for complete search history.

(56) References Cited

FOREIGN PATENT DOCUMENTS

| | | | | |
|---|---|---|---|---|
| CN | 105356119 A | | 2/2016 | |
| CN | 108987978 A | * | 12/2018 | ..... H01R 33/965 |

* cited by examiner

*Primary Examiner* — Abdullah A Riyami
*Assistant Examiner* — Justin M Kratt
(74) *Attorney, Agent, or Firm* — Ming Chieh Chang; Wei Te Chung

(57) ABSTRACT

An electrical connector includes: a contact module including a housing and an upper and lower rows of contacts arranged in the housing, the housing having a base and a front tongue; a metallic shell enclosing the housing; and a metallic bracket affixed to the metallic shell and having a pair of soldering legs; wherein the base has a front face and plural recesses behind the front face, each recess having an interior face; and the metallic shell has plural stops accommodated in corresponding recesses, each stop having a front face positioned in front of the front face of the base and a rear face spaced a gap from the interior face of a corresponding recess.

11 Claims, 7 Drawing Sheets

ELECTRICAL CONNECTOR WITH STOP POSITIONED ON METALLIC SHELL

BACKGROUND OF THE INVENTION

1. Field of the Invention

The present invention relates to an electrical connector comprising a contact module, a metallic shell enclosing the contact module and having plural stops for arresting a complementary electrical connector, and a metallic bracket affixed to the metallic shell and having a pair of soldering legs, wherein an insulative base of the contact module has plural corresponding recesses so dimensioned to accommodate corresponding stops that a slight deformation of the stop does not impact the insulative base.

2. Description of Related Arts

China Patent No. 105356119 discloses an electrical connector comprising: a contact module including a housing and an upper and lower rows of contacts arranged in the housing, the housing having a base and a front tongue; a metallic shell enclosing the housing; and a metallic bracket affixed to the metallic shell and having a pair of soldering legs; wherein the base has a front face and a plurality of recesses behind the front face, each recess having an interior face; and the metallic shell has a plurality of stops accommodated in corresponding recesses, each stop having a front face positioned in front of the front face of the base and a rear face engaging the interior face of a corresponding recess.

SUMMARY OF THE INVENTION

An electrical connector comprises: a contact module including a housing and upper and lower rows of contacts arranged in the housing, the housing having a base and a front tongue; a metallic shell enclosing the housing; and a metallic bracket affixed to the metallic shell and having a pair of soldering legs; wherein the base has a front face and a plurality of recesses behind the front face, each recess having an interior face; and the metallic shell has a plurality of stops accommodated in corresponding recesses, each stop having a front face positioned in front of the front face of the base and a rear face spaced a gap from the interior face of a corresponding recess.

DETAILED DESCRIPTION OF THE PREFERRED EMBODIMENTS

Figure 1:
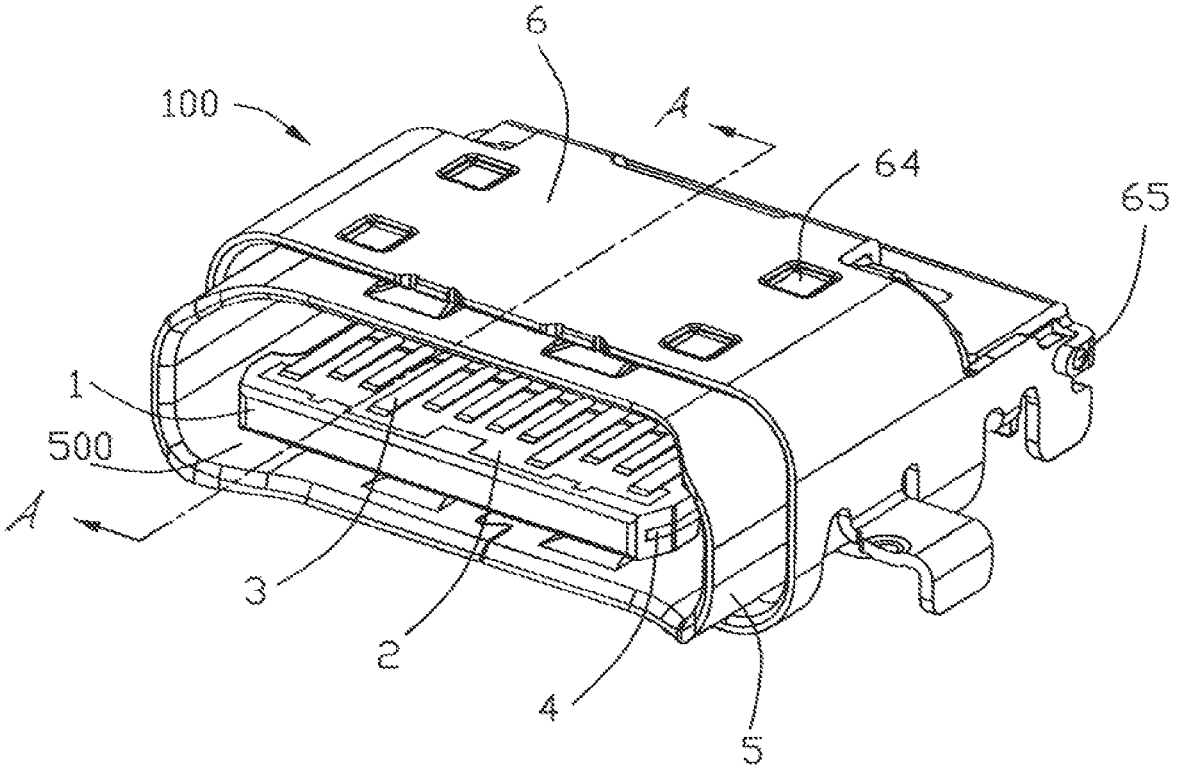
FIG. 1 is a front perspective view of an electrical connector in accordance with the present invention.
Figure 2:
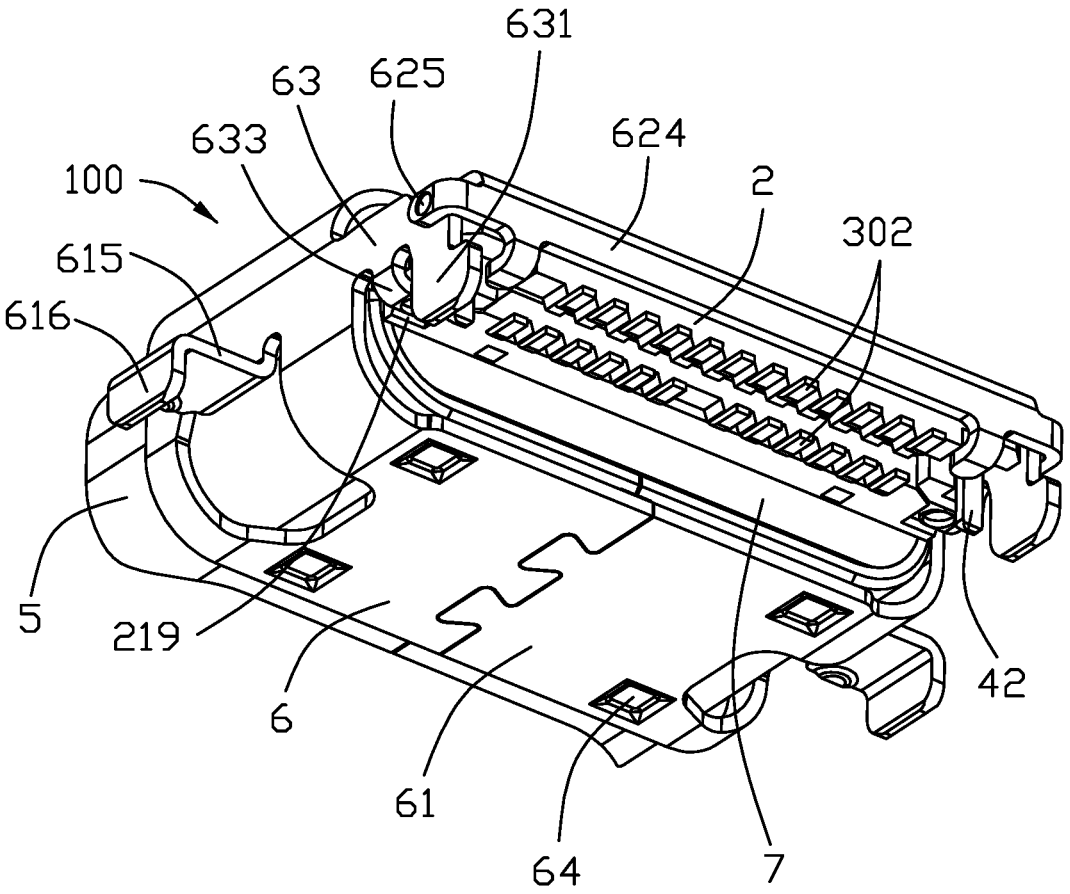
FIG. 2 is a rear perspective view of the electrical connector.
Figure 3:
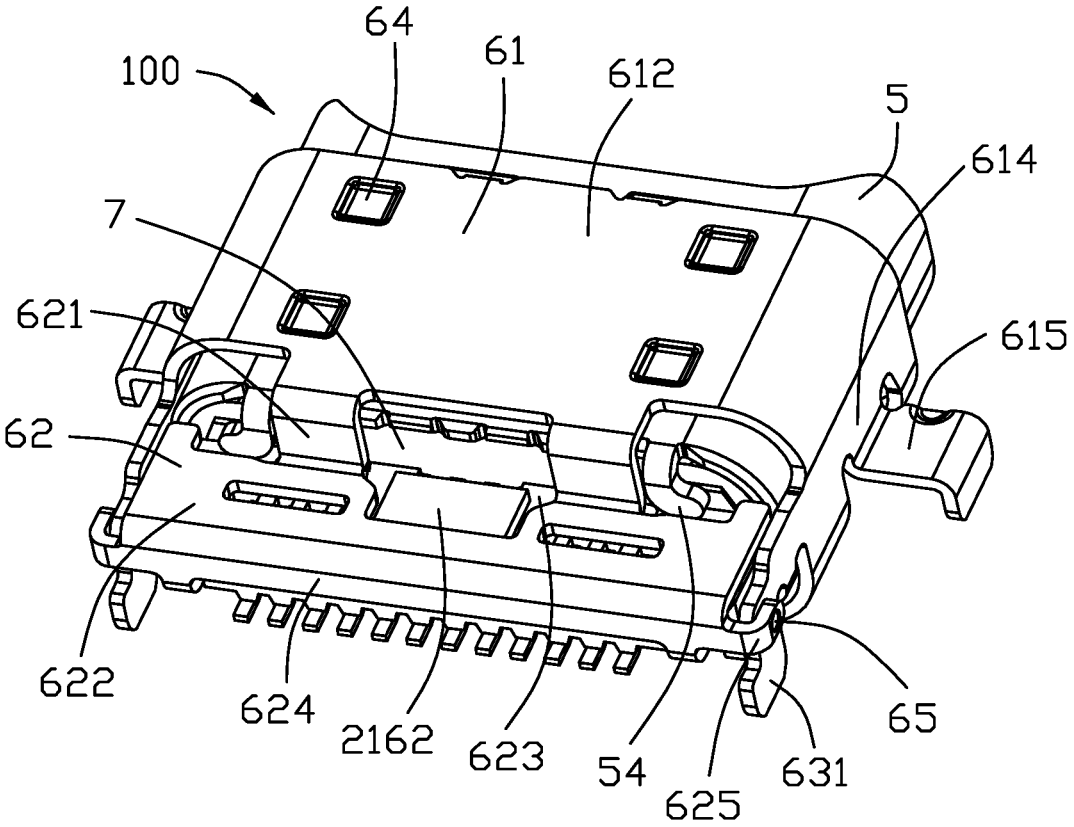
FIG. 3 is another rear perspective view of the electrical connector.
Figure 4:
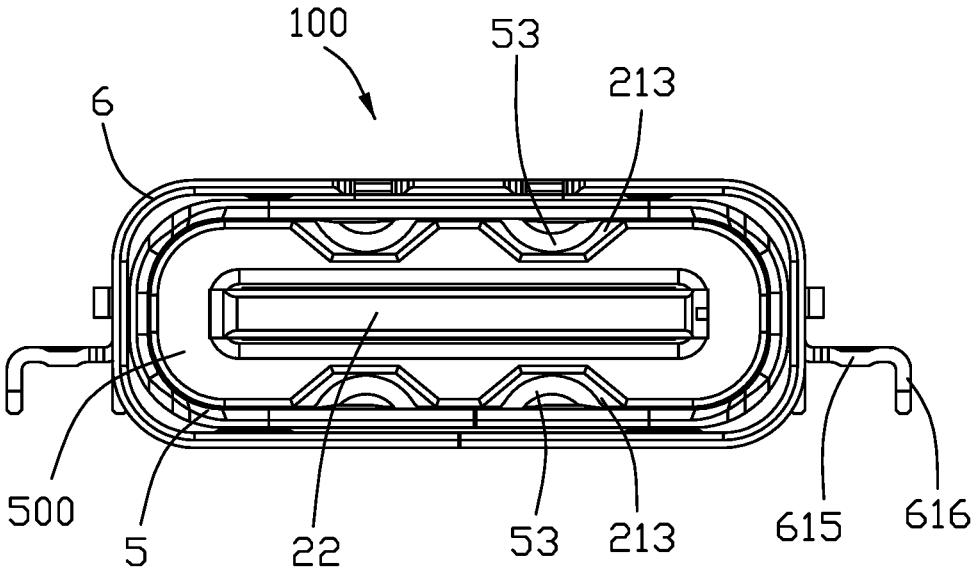
FIG. 4 is a front plan view of the electrical connector.
Figure 5:
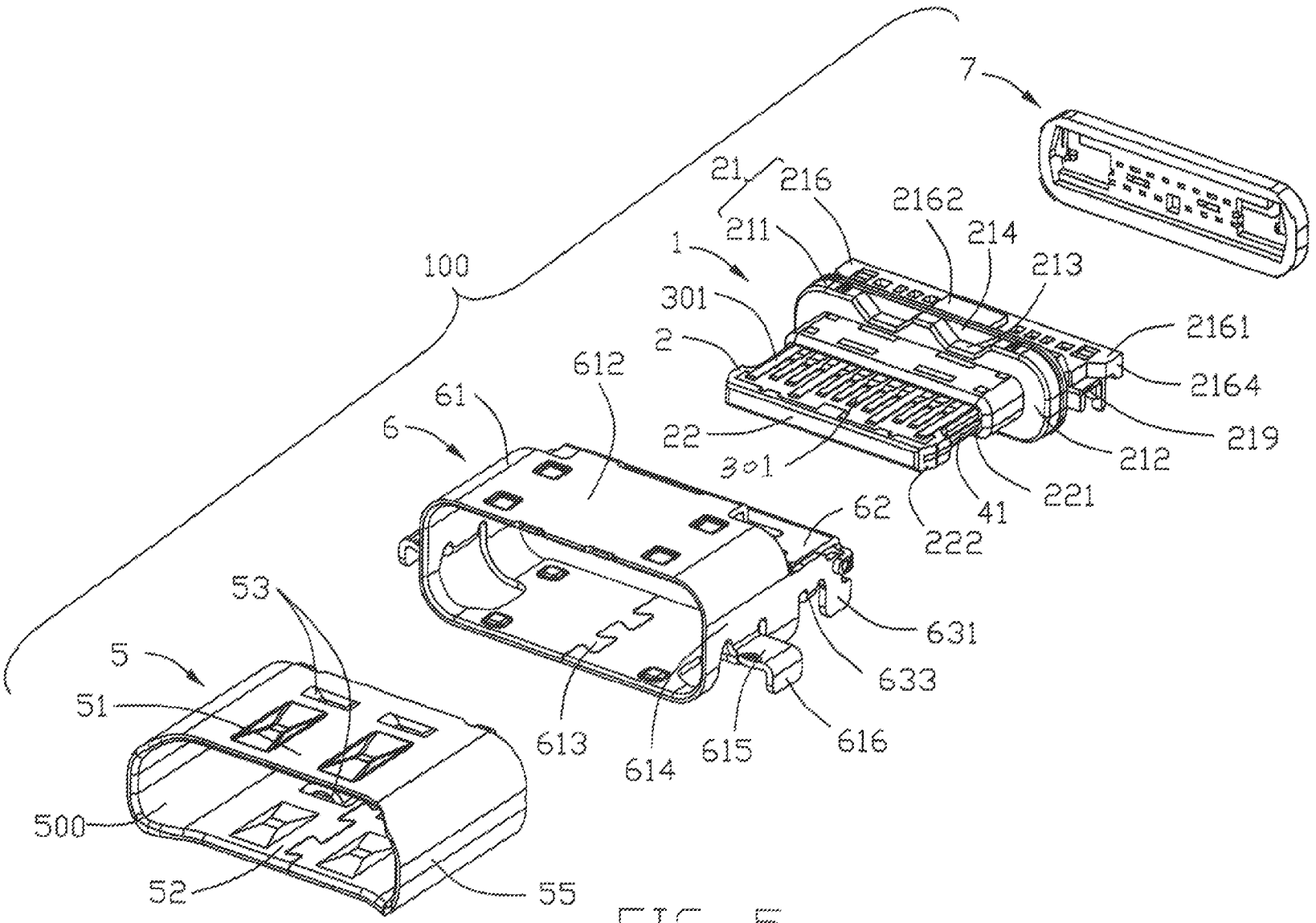
FIG. 5 is a front exploded view of the electrical connector.
Figure 6:
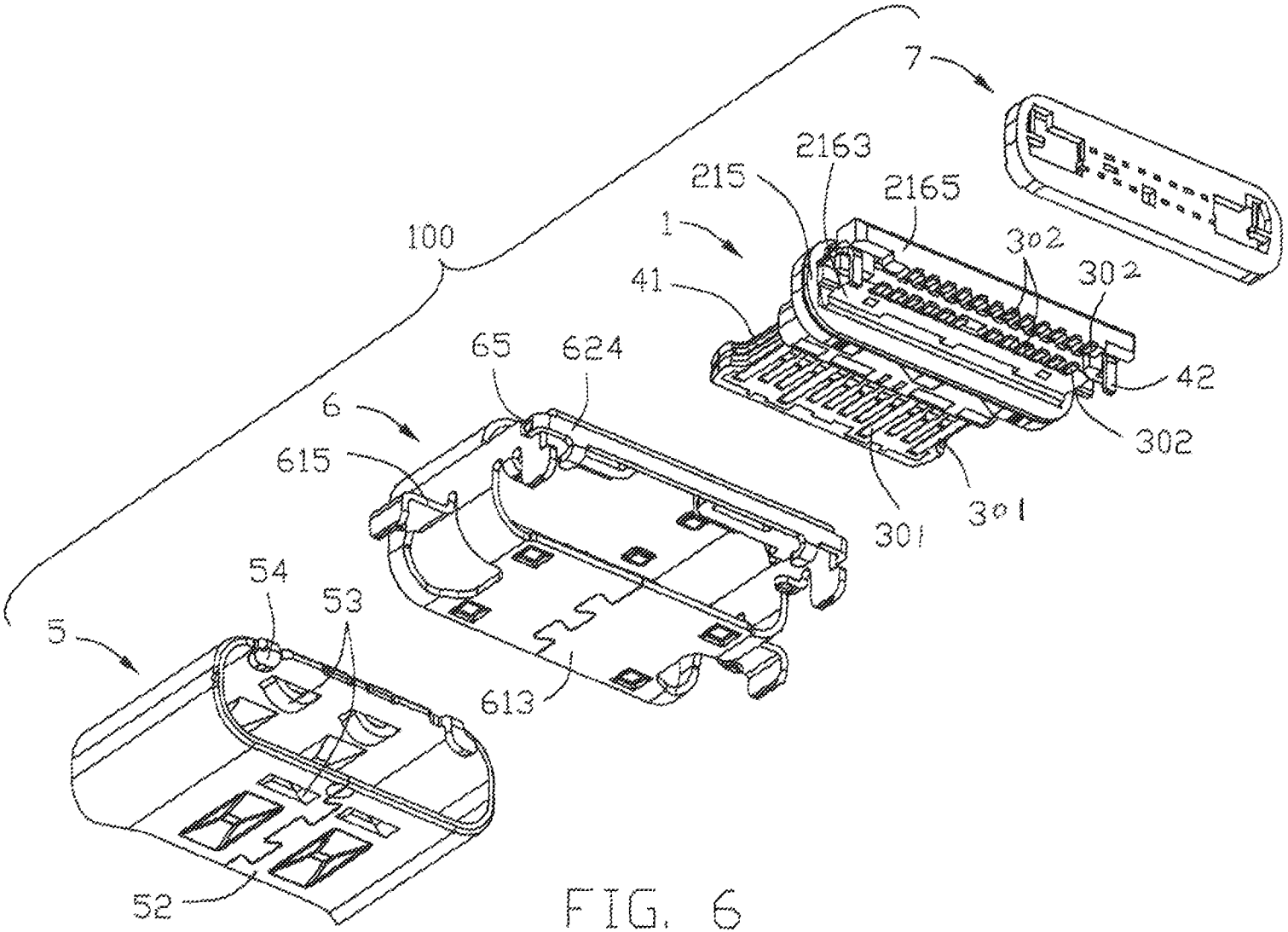
FIG. 6 is a rear exploded view of the electrical connector.
Figure 7:
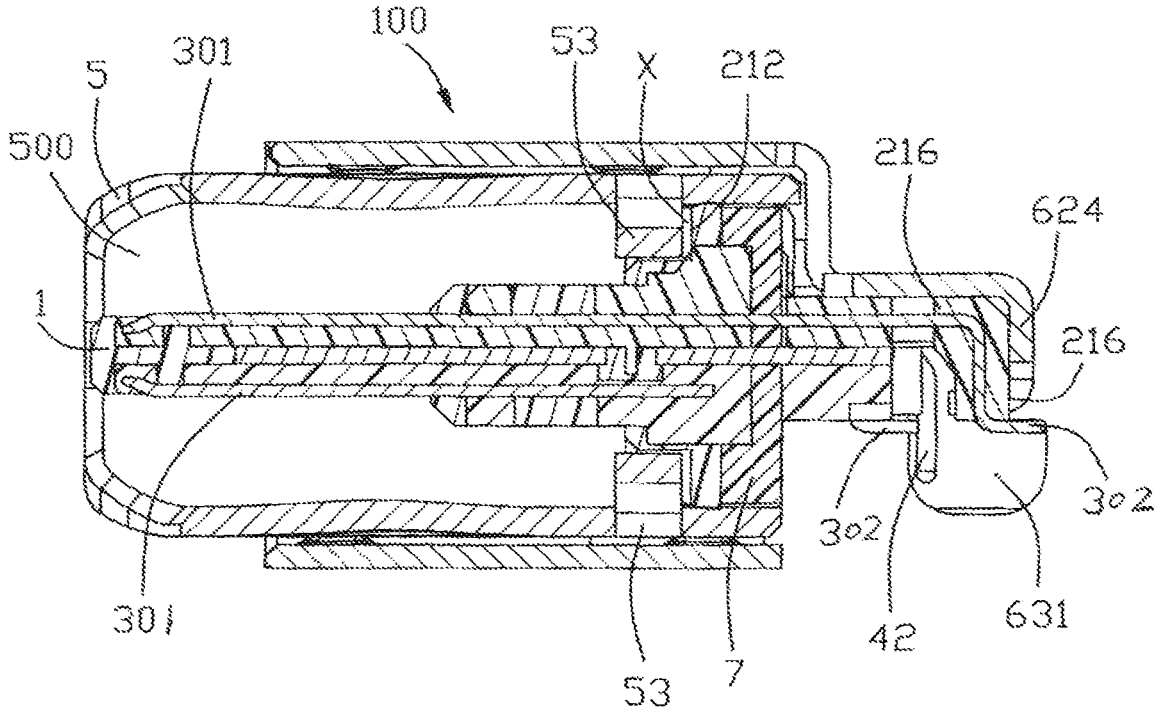
FIG. 7 is a cross-sectional view of the electrical connector taken along line A-A in FIG. 1.

Referring to FIGS. 1-7, an electrical connector 100 to be mounted to a printed circuit board comprises a contact module 1, a metallic shell 5 enclosing the contact module 1, and a metallic bracket 6 affixed to the metallic shell 5. The electrical connector 100 may further comprise a rear sealing member 7.

The contact module 1 includes an insulative housing 2 and an upper and lower rows of contacts 3 arranged in the housing 2. The contact module 1 may further include a shielding plate 4 in the housing 2 between the two rows of contacts 3.

Referring to FIGS. 1-4, the housing 2 includes a base 21 and a front tongue 22. The base 21 has a main part 211 and a rear mount 216. A platform is formed at a junction of the main part 211 and the tongue 22; another platform is formed at a junction of the main part 211 and the rear mount 216. The main part 211 has a front face 212 and two upper and two lower recesses 213 behind the front face. Each recess 213 has an interior face 214. The main part 211 has a rear face 215. The rear mount 216 has an upper surface 2161, a lower surface 2163, two side surfaces 2164, and a rear surface 2165. The rear mount 216 has a protrusion 2162 at the upper surface 2161. The tongue 22 has two side notches 221 and associated protrusions 222 in front of the side notches.

Each contact 3 has a securing portion, a front contacting portion 301, and a rear soldering portion 302. The two rows of contact 3 are generally arranged in the housing 2 in a well-known manner in this art.

The shielding plate 4 has a main part 41 and a pair of soldering legs 42.

The metallic shell 5 has an upper wall 51, a lower wall 52, and a pair of side walls 55. A receiving space 500 is defined between the metallic shell 5 and the tongue 22 for receiving a complementary electrical connector. Each of the upper wall 51 and the lower wall 52 has two stops 53 protruding into the space 500 by metalworking for about 0.45 mm and for a front-to-back lengthwise dimension of about 0.55 mm. The stops 53 are accommodated in corresponding recesses 213. Each stop 53 has a front face positioned in front of the front face 212 of the main part 211 and a rear face spaced a gap X from the interior face 214 of an associated recess 213. The gap X is about 0.1-0.2 mm, preferably 0.1 mm. To produce the gap X, the housing 2 may have a portion forwardly abutting a rear end face of the metallic shell 5 when the housing 2 is mounted to the metallic shell 5. For example, the housing 2 forms a pair of grooves 219 on opposite lateral sides, and the bracket 6 forms a pair of retaining tabs 633 respectively snugly received therein. The upper wall 51 further has a pair of abutments 54.

The metallic bracket 6 has a main part 61, a rear cover 62, and a pair of side extensions 63. The main part 61 has an upper wall 612, a lower wall 613, and a pair of side walls 614. Each side wall 614 has a bend 615 with a securing leg 616. The rear cover 62 has a front vertical portion 621, a horizontal portion 622, and a rear vertical portion 624. The portion 621 is positioned behind the metallic shell 5. The portion 622 has a hole 623 for receiving the protrusion 2162 of the rear mount 216 so that the rear cover 62 forwardly abuts the protrusion 2162 when assembled. The rear vertical portion 624 forwardly abuts the rear surface 2165 of the rear mount 216. The pair of side extensions 63 extend rearwardly from the pair of side walls 614. Each side extension 63 has a securing leg 631. The portion 624 further has a pair of clips 625. The securing legs 616 and 631 are to be secured to a printed circuit board.

The upper and lower walls 612 and 613 of the metallic bracket 6 are spot-welded to the upper and lower walls 51 and 52 of the metallic shell 5 at four locations 64, respectively. The pair of clips 625 are spot-welded to the securing legs 631 at locations 65.

The sealing member 7 is formed behind the at an end of the metallic shell 5 and around its interface with the contact module 1.

The front faces of the stops 53 are designed to arrest an inserted complementary electrical connector in order to protect the contact module 1. With the gap X between the rear faces of the stops 53 and the interior faces 214 of the recesses 213, external forces applied to the stops 53 along a front-to-back direction will not impact the base 21 which otherwise would adversely affect structure of the contact module 1 soldered to the printed circuit board.

What is claimed is:

1. An electrical connector comprising:

a contact module including a housing and upper and lower rows of contacts arranged in the housing, the housing having a base and a front tongue;

a metallic shell enclosing the housing; and a metallic bracket affixed to the metallic shell and having a pair of soldering legs; wherein the base has a front face and a plurality of recesses behind the front face, each recess having an interior face; and the metallic shell has a plurality of stops accommodated in corresponding recesses, each stop having a front face positioned in front of the front face of the base and a rear face spaced a gap from the interior face of a corresponding recess.

2. The electrical connector as claimed in claim 1, wherein a dimension of the gap is 0.1 mm to 0.2 mm.

3. The electrical connector as claimed in claim 1, wherein the plurality of stops comprise two upper stops and two lower stops.

4. The electrical connector as claimed in claim 1, wherein:

the base includes a rear mount having a protrusion; and the metallic bracket includes a main part and a rear cover, the rear cover forwardly abutting the protrusion.

5. The electrical connector as claimed in claim 1, wherein the housing is mounted to the metallic shell with a portion thereof forwardly abutting a rear end face of the metallic shell to produce the gap.

6. An electrical connector comprising:

a contact module including a housing and upper and lower rows of contacts arranged in the housing, the housing having a base and a front tongue forwardly extending from a front surface of the base in a front-to-back direction;

a metallic shell enclosing the housing; and a metallic bracket affixed to the metallic shell and having a pair of soldering legs; wherein the base has a front face with a plurality of recesses therein; and the metallic shell has a plurality of stops accommodated in corresponding recesses, each stop having a front face positioned in front of the front surface of the base, and a rear face spaced from the base so as not to have forces, which are applied upon the stop by a complementary mating plug, directly imposed upon the base by the stop.

7. The electrical connector as claimed in claim 6, wherein the base forms a pair of opposite lateral grooves, and the bracket forms a pair of retaining tabs received with the corresponding grooves, respectively to stop further forward movement of the housing relative to the bracket.

8. The electrical connector as claimed in claim 7, wherein the bracket further includes a rear vertical portion forwardly abutting against a rear face of the housing to stop further rearward movement of the housing relative to the bracket.

9. The electrical connector as claimed in claim 8, wherein said bracket further includes a pair of side extensions with corresponding soldering legs, and the rear vertical portion is welded to the corresponding side extension around the corresponding soldering legs.

10. The electrical connector as claimed in claim 9, wherein in the bracket the rear vertical portion extends from a horizontal portion having an opening to receive a corresponding protrusion formed on the base.

11. The electrical connector as claimed in claim 9, wherein said stops include two stops on an upper side and two stops on a lower sides in a symmetrical manner.

* * * * *